US006102236A

United States Patent [19]

Ohlsson et al.

[11] Patent Number: 6,102,236

[45] Date of Patent: Aug. 15, 2000

[54] LID OF A CONTAINER FOR BEVERAGES

[75] Inventors: Per Ohlsson, Surrey, United Kingdom; Elmar Mock, Biel, Switzerland

[73] Assignee: Tetra Laval Holdings & Finance S.A., Pully, Switzerland

[21] Appl. No.: 09/341,917

[22] PCT Filed: Jan. 31, 1997

[86] PCT No.: PCT/US97/01823

§ 371 Date: Oct. 25, 1999

§ 102(e) Date: Oct. 25, 1999

[87] PCT Pub. No.: WO98/33718

PCT Pub. Date: Aug. 6, 1998

[51] Int. Cl.[7] ..... B65D 43/04

[52] U.S. Cl. ..... 220/254; 220/359.2; 220/359.3; 229/123.1

[58] Field of Search ..... 220/212, 254, 220/258, 259, 265, 266, 268, 269, 270, 271, 277, 278, 359.1, 359.2, 359.4, 789, 791; 215/228, 226; 229/123.1, 123.2, 125.35

[56] References Cited

U.S. PATENT DOCUMENTS

| | | | |
|---|---|---|---|
| 3,990,603 | 11/1976 | Brochman . | |
| 4,595,114 | 6/1986 | Lu . | |
| 4,735,336 | 4/1988 | Buchner et al. . | |
| 4,948,008 | 8/1990 | Wu et al. . | |
| 5,103,973 | 4/1992 | Sato . | |
| 5,219,086 | 6/1993 | Bjorck | 220/359.2 |
| 5,303,838 | 4/1994 | Luch et al. | 220/359.4 |
| 5,653,383 | 8/1997 | Adachi et al. | 220/359.2 |
| 5,772,060 | 6/1998 | Kaneko et al. | 220/359.2 |

FOREIGN PATENT DOCUMENTS 96-16870 6/1996 WIPO .

*Primary Examiner*—Nathan J. Newhouse
*Attorney, Agent, or Firm*—Burns, Doane, Swecker & Mathis, L.L.P.

[57] ABSTRACT

A beverage container lid (1) includes a lid body (10) and a pull cap (20) that are both made of thermoplastic resin. The lid body is provided with an opening (11) for discharging contents from the container when the lid is mounted on a beverage container (40). The pull cap (20) includes a cap portion (21) and a pull tab portion (22) that are connected to one another. The lid body is made from a laminate that includes an easy-peel layer and a gas-barrier layer. The easy-peel layer forms an outermost layer of the lid body. The opening (11) in the lid body (10) is covered with a gas-barrier film (15) and the film is bonded to the peripheral portion (14) of the lid body surrounding the opening (11). The lower surface of the peripheral portion (23) of the cap portion (21) is removably attached to the upper surface (13) of the lid body (10) through the gas-barrier layer (15).

18 Claims, 2 Drawing Sheets

LID OF A CONTAINER FOR BEVERAGES

FIELD OF THE INVENTION

This invention generally relates to lid structures and more particularly is concerned with the structure of a lid for a beverage container that can be opened for drinking or otherwise discharging the contents and subsequently reclosed.

BACKGROUND OF THE INVENTION

Conventional containers for beverages are constructed so that the upper end opening of the container is covered and sealed with a lid. In this type of beverage container, the container is filled with beverage after the container interior has been sterilized to provide an aseptic state.

Known lids for the aforementioned types of containers typically take one of several forms. A lid of the so-called peelable seal type (hereinafter referred to as membrane type), which is made of a sheet including a stretched PET (polyethylene terephthalate) film, is laminated on the surface of an aluminum foil layer, and an easy peel layer is provided on the side thereof which comes into contact with the container. The lid is mounted to cover the open upper end of the container and is fuse-bonded in place by heating.

Another form of lid involves a sheet that covers the open upper end of a container and is provided with an opening that serves as a drinking or discharge hole. The lid has a pull tab covering the opening, with the pull tab being formed from a small piece of PET/aluminum foil having an easy peel layer.

A different lid construction is one in which the lid is shaped by draw-forming aluminum foil.

A further type of lid construction involves preparing the lid by so-called insert injection molding in which an aluminum foil coated with PE (polyethylene) is previously inserted into a mold and in which the lid having a desired opening means in the aluminum foil is molded by injection molding.

The above-described forms of conventional lids suffer from a variety of drawbacks and disadvantages. For example, in the membrane type lid described above, the seal strength between the lid and the container must be high enough to withstand handling during transportation of the products. On the other hand, the opening strength required for removing the lid from the container should not be so high that opening of the lid is made excessively difficult. It can be appreciated that it is oftentimes difficult to balance these two requirements.

Further, since the opening in the container that results after the removal of the lid from the container is rather large, an inconvenience arises in that the beverage is apt to spill when, for example, the beverage in the container is being consumed while walking.

In the case of the above-described lid having a pull tab, the problems associated with the membrane type lid are not as prevalent. However, since the pull tab is formed of a membrane-type sheet, the lid does not present a high quality feeling but rather gives a somewhat "cheap-looking" appearance or impression to the lid.

The above-described lid in which an aluminum foil is draw-formed suffers from the drawback that it is relatively expensive.

The last type of lid described above possesses gas-barrier properties, but is nevertheless problematic because coating the aluminum foil with PE is complicated and the lid is susceptible of being easily peeled off.

Most of the above conventional lids are removed and separated from the beverage container after the container has been opened so that a disposal problem for the lid also arises. Even in the case of a lid which is not removed from the container at the time of opening, the current technology is such that the opened container cannot be sealed again with the lid.

SUMMARY OF THE INVENTION

The present invention is designed to address the foregoing problems. The present invention is aimed at providing a lid for a beverage container which can withstand handling during transportation of the products, which can be easily opened, which has excellent gas-barrier properties, which has a high grade appearance, which can be used again for sealing of the container once the container has been opened, and which is well suited for aseptic filling of the beverage into the container.

In accordance with the present invention, a lid of a container for beverages is made of thermoplastic resin and is shaped to cover an upper end opening of a container. The lid includes a lid body and a pull cap both made of thermoplastic resin. The lid body has an opening for discharging contents from the container, and the pull cap includes a cap portion disposed above the opening in the lid body and a pull tab portion that is connected to the cap portion. The lid body is made from a laminate that includes an easy-peel layer and a gas-barrier layer. The easy-peel layer forms an outermost layer of the lid body. The opening in the lid body is covered with a gas-barrier film and the film is secured to the peripheral portion of the lid body surrounding the opening. The cap portion has a lower surface which faces an upper surface of the lid body. The lower surface of the cap portion is removably attached along its periphery to the upper surface of the lid body through the gas-barrier film.

According to another aspect of the invention, a beverage container lid includes a lid body and a pull cap. The lid body is provided with an opening through which can be discharged contents, and the lid body includes a periphery that is configured to permit the lid to be mounted on an open upper end of a container. The pull cap includes a cap portion and a pull tab portion that are connected to one another. A gas-barrier film is sealed to the upper surface of the lid body and extends across the opening in the lid body to close the opening. The lower surface of the cap portion is removably attached to the gas-barrier film along the peripheral portion of the cap portion to permit removal of the gas-barrier film covering the opening when the pull cap is separated from the lid body so that the opening in the lid body is opened.

BRIEF DESCRIPTION OF THE DRAWING FIGURES

Additional details and features of the present invention will become more apparent from the detailed description set forth below considered in conjunction with the accompanying drawing figures in which like elements are designated by like reference numerals and wherein.

DETAILED DESCRIPTION OF THE INVENTION

Figure 1:
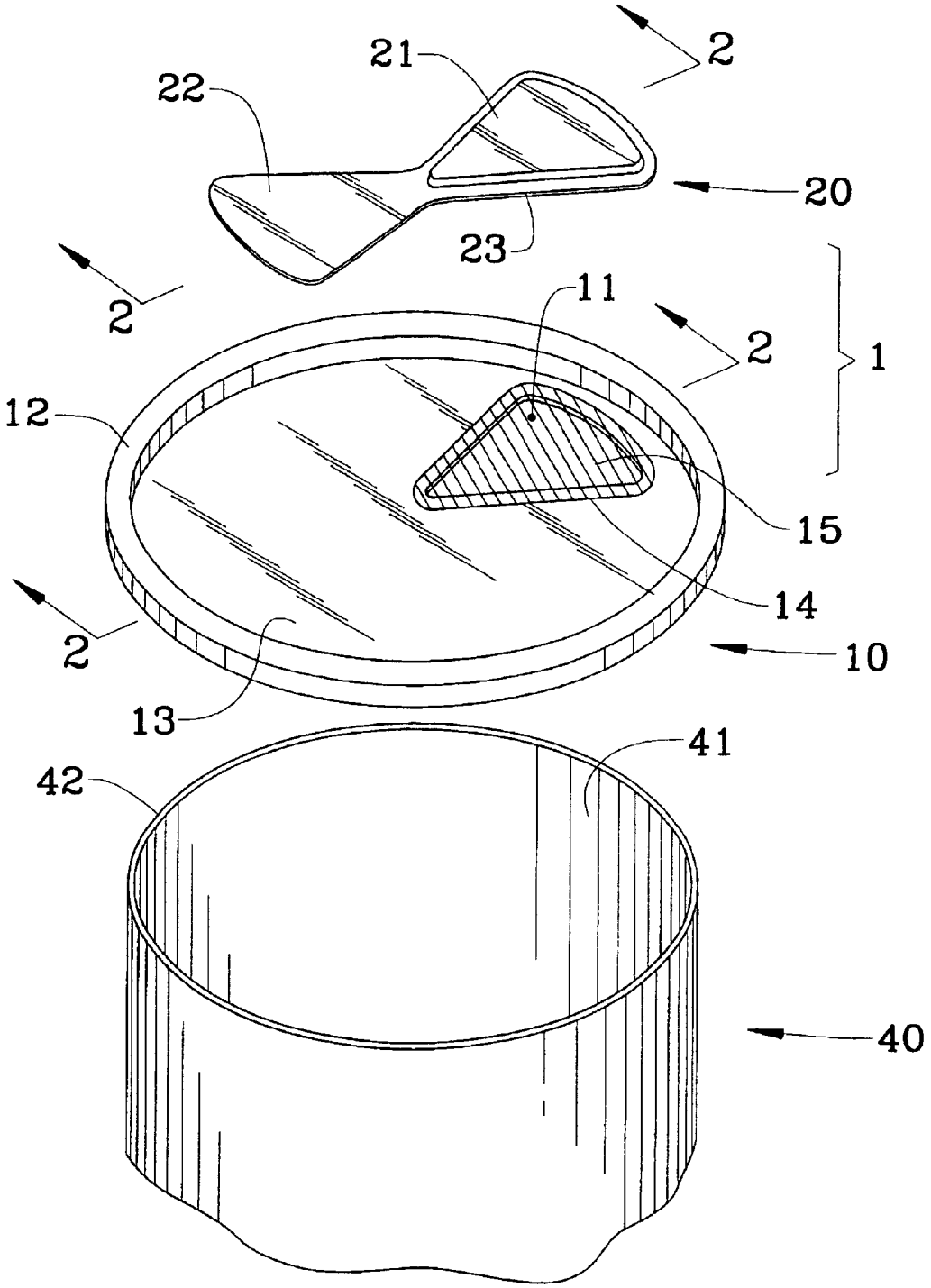
FIG. 1 is an exploded perspective view showing a lid according to an embodiment of the present invention for being attached to an open upper end of a beverage container.
Figure 2:
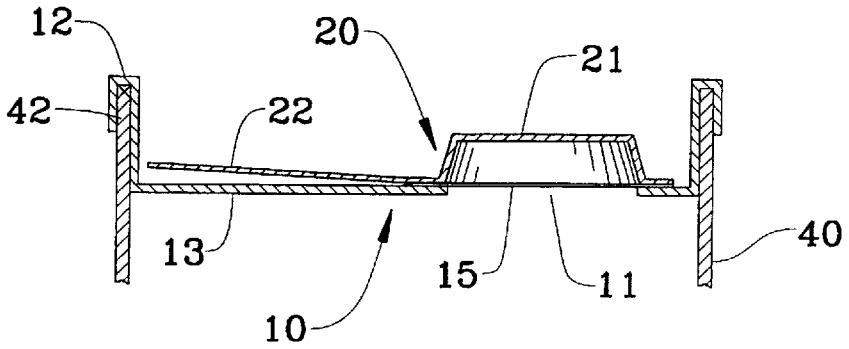
FIG. 2 is a cross-sectional view of the lid shown in FIG. 1 attached to the upper portion of a container and taken along the section line 2—2 in FIG. 1.
Figure 3:
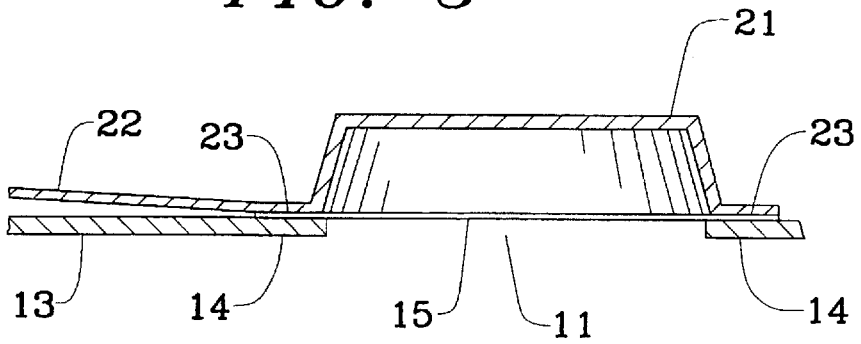
FIG. 3 is an enlarged cross-sectional view of a portion of the lid depicted in FIG. 2.

Referring to FIG. 1, a container 40 has an upper opening 41 into which a lid 1 according to the present invention is fitted to form a container for holding a beverage. The lid 1 is a two-piece construction that includes a pull cap 20 and a lid body 10. The lid body is provided with an opening 11 that serves as a drinking hole. The shape of the opening 11 is not limited only to a sector shaped construction such as that shown in FIG. 1, but may be any desired form or shape. As shown in FIG. 2, the outer periphery of the lid body 10 is provided with a flange 12 that forms a fitting engagement with the upper end portion 42 of the container 40 so that the lid 1 can be mounted on and secured to the open upper end of the container. As shown in FIG. 3, a gas-barrier film 15 is sealed to the upper surface of the lid body 10 in the peripheral portion of the lid body 10 that surrounds the opening. Additionally, the gas-barrier film 15 extends across the opening 11 in the lid body 10 to cover and seal the opening 11.

Figure 4:
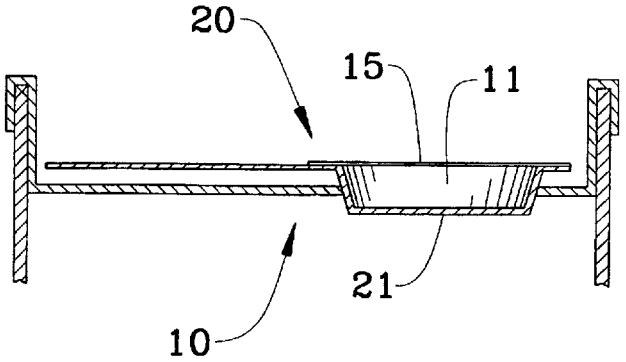
FIG. 4 is a cross-sectional view of the lid shown in FIG. 2 illustrating the pull cap inserted and fitted into the opening in the lid body to reclose and seal the container after the container has been opened.

The pull cap 20 includes a cap portion 21 and a pull tab portion 22 that are integrally formed in one piece. The cap portion 21 of the pull cap 20 generally corresponds in peripheral shape to the opening 11 in the lid body 10 so that the cap portion 20 can be fitted into the opening 11 when the pull cap 20 is inverted upside down, as shown in FIG. 4, after the container has been opened. Therefore, the shape of the cap portion 21 varies with the shape of the opening 11 in the lid body 10, and the shape shown in the drawing figures is merely an example.

In the illustrated embodiment, the cap portion 21 is in the form of a truncated triangular shaped cone with the smaller end of the cap portion (i.e., the uppermost end in FIGS. 2 and 3) being smaller in size than the size of the opening 11 in the lid body 10. The truncated cone shaped cap portion 21 gradually increases in outer peripheral size along its height so that the largest outer size of the cap portion 21 preferably equals or exceeds the diameter of the opening 11 in the lid body 10. This allows the cap portion 21 to be relatively tightly fitted in place in the opening 11 of the lid body as shown in FIG. 4. As a result, the lid can be reclosed once it has been opened so that the contents in the container do not spill out.

The pull tab portion 22 in the illustrated embodiment is connected to the cap portion 21 so that the pull tab portion 22 slants upwardly relative to the cap portion 21. As a result, the pull tab portion 22 can be easily pinched or grouped to open the container. However, the pull tab portion 22 may be oriented parallel with the upper surface 13 of the lid body 10 or may be in contact with an easy peel layer which represents the uppermost layer of the lid body 10. Alternatively, the upward inclination angle of the pull tab portion 22 can be made greater than that shown in the drawing figures.

Since the pull tab portion 22 does not project beyond the upper surface of the flange 12, the pull tab portion 22 is not likely to be caught by something during the course of handling and transportation. Consequently, there is no concern that the lid will be inadvertently opened or that the contents will be unintentionally discharged. Further, this arrangement does not prevent a plurality of the containers from being accommodated in a corrugated carton, and does not interfere with the ability of the containers to be displayed in storefronts.

The lid body 10 and the pull cap 20 are integrated or connected together by the connection of the peripheral portion 14 of the lid body surrounding the opening 11 and the lower surface of the peripheral portion 23 of the pull cap 20 through the gas-barrier film 15 which covers the upper surface of the lid body along the peripheral portion 14 of the opening 11 as shown in FIG. 3. More specifically, the gas-barrier film 15 is sealed to the outer surface of the lid body 10 in the region of the lid body 10 surrounding the opening 11 while the lower surface of the peripheral portion 23 of the cap portion 21 is sealed to the gas-barrier film 15. Thus, as can be seen in FIGS. 2 and 3, the gas-barrier film 15 is interposed between the lower surface of the pull cap 20 and the upper surface of the lid body 10. The connection may be by fuse-bonding or by an adhesive. The connection with fuse-bonding is preferred, however.

The lid 1 is preferably formed of a thermoplastic resin. The thermoplastic resin may be polyolefin, polyethylene terephthalate (PET), polybutylene terephthalate (PBT), polyamide (PA), polystyrene (PS), polyvinyl chloride (PVC), an ethylene-vinyl acetate copolymer resin (EVA), an acrylonitrile-butadiene-styrene copolymer resin (ABS), a methacrylic resin (PMA), polycarbonate (PC), ionomer, a cyclic olefin-a-olefin copolymer resin, etc. Polyolefin is a particularly suitable and preferred thermoplastic material.

Possible polyolefins include polyethylene (low density polyethylene, medium density polyethylene, high density polyethylene, linear low density polyethylene, etc.) (PE), polypropylene (propylene homopolymer, an ethylene-propylene random copolymer, an ethylene-propylene block copolymer, etc.), polybutene-1, polyhexene-1 and polymethylpentene-1. These polyolefins may be used singly or in combination of two or more.

Among the above polyolefins, PE, PP or a mixture thereof is particularly desirable.

The lid body 10 is made of a laminate that includes a base layer of the above thermoplastic resin, an easy peel (EP) layer, and a gas-barrier film (GBF) layer. The EP layer represents the uppermost layer of the laminate. Thus, the laminate basically has a construction of EP (uppermost layer)/base (intermediate layer)/GBF (inner layer) or EP/GBF/base.

It is to be understood that various modifications may be employed within the context of the above basic construction. For example, it is possible to utilize an embodiment in which an adhesive layer or other member layer is interposed between the above layers. Also, the base layer or other member layer can be formed as a multilayer structure. Illustrative of such other member layer is a so-called scrap layer formed by using resin refuses produced in molding the lid body.

As the easy peel layer providing the uppermost layer or outer surface of the lid body 10, various films can be used. These include, by way of example, San Seal manufactured by San-ei Chemical Co., Ltd., Magic Top manufactured by Idemitsu Petrochemical Inc. or VMX manufactured by Mitsubishi Chemical Co., Ltd. The thickness of the easy peel layer may be 100 $\mu$m or less.

The gas-barrier film constituting part of the lid body 10 should preferably be made of a material having gas barrier properties, particularly oxygen barrier properties. Such a material can include an ethylene-vinyl alcohol copolymer (EVOH), polyvinylidene chloride, and others. EVOH is particularly preferred. The thickness of the gas-barrier film layer may be on the order of 100 $\mu$m or less.

As noted above, the opening 11 is covered with a gas-barrier film 15 that is sealed to the upper surface of the lid body 10. This film 15 may be made of the same material as that of the gas-barrier film used for the lid body 10. A film made of the above material may be used by itself. Alternatively, a laminate consisting of two or more layers, one of which is another material such as the above-mentioned thermoplastic resin materials, may be used.

It is especially advantageous to use, as the gas-barrier film 15, a laminate having a construction in which the layer or portion of the laminate which is to contact the upper surface 13 of the lid body 10 is a layer formed of the same kind of thermoplastic resin as that of the lid body 10, and in which the layer or portion of the laminate which is to contact the lower surface of the peripheral portion 23 of the pull cap 20 is formed of the same kind of thermoplastic resin as that of the pull cap 20. In this way, the layers can be easily fuse-bonded with the respective surfaces in the fabrication of the lid 1 according to the present invention. Illustrative of such a film is a laminate of PP/EVOH/PP. Optionally, an adhesive layer may be interposed between these resin layers.

The pull cap 20 is made of a thermoplastic resin selected from those described above. The thermoplastic resin may be the same as or different from that of the base layer of the lid body 10. It is advantageous to use a thermoplastic resin which is softer than that of the base layer of the lid body 10. In this way, the resulting pull cap is soft and easily deformable, permits easy insertion and fitting of the cap portion 21 into the opening 11 for sealing the opening therewith, and provides good grasping characteristics.

Such a soft thermoplastic resin is preferably atactic polyolefin, especially atactic polypropylene or amorphous polypropylene.

When the container 40 is filled with beverage and closed with the lid 1, the gas barrier property in the lid 1 is sufficiently ensured by the gas-barrier film 15 covering the opening 11 in the lid body 10. In conjunction with the gas-barrier property of the container 40 itself (inclusive of a bottom material, if any), this construction can function to preserve the liquid food while also preventing the deterioration of the food and the detrimental influence of outside foreign odors.

A container charged with contents typically arrives at the final consumer through a distribution channel. The final consumer interested in drinking the contents can easily open the container by pulling up on the pull tab portion 22. Since the uppermost layer of the lid body 10 is made of the easy peel layer as described above, the pull cap 20 is easily separated together with the gas-barrier film 15. Thus, the opening 11 is completely opened to permit drinking or pouring of the contents. The gas-barrier film 15 remains secured to the cap portion 21 of the pull cap 20 as shown in FIG. 4.

When the contents in the container are not completely emptied, the pull cap 20 can be inverted upside down from the originally attached state and the cap portion 21 then inserted into the opening 11. In this way, the opening 11 is again closed so that the liquid food can be temporarily stored in this state.

The present invention is quite advantageous in a variety of respects. In one respect, the lid construction has sufficient strength to withstand handling during transportation and has excellent gas-barrier properties. Also, since the gas-barrier film 15 is positioned between the cap portion 21 of the pull cap 20 and the outer surface of the lid body, the gas-barrier film 15 is protected by the cap portion 21 of the pull cap 20. Thus, the gas-barrier film 15 is not exposed and thus is not susceptible of being inadvertently punctured or otherwise opened. Consequently, the gas-barrier film 15 need not have significant mechanical strength and can be made rather thin. Further, since only the peripheral portion of the lid body 10 surrounding the opening is bonded to the gas-barrier film, only a small force is required to fracture and peel the film for opening the container.

The container is also made easy to open by virtue of the uppermost or outer surface of the lid body 10 being formed of the easy peel layer. Additionally, when the container contents are not completely consumed or otherwise emptied from the container, the opening in the lid can be advantageously reclosed with the removed pull cap so that it is easy to store the remaining beverage and transport the container.

Further, when the container is to be discarded after drinking of the beverage, the container and the pull cap can be disposed together by inserting and fitting the removed pull cap into the opening. The present invention is also advantageous in that the lid has a high quality appearance and permits easy sterilization of the container after filling the beverage.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A lid to be attached to an open end of a beverage container, comprising a lid body and a pull cap both made of thermoplastic resin, said lid body having an opening for discharging contents from the container, said pull cap including a cap portion disposed above said opening in the lid body and a pull tab portion that is connected to said cap portion, said lid body being made from a laminate that includes an easy-peel layer and a gas-barrier layer, the easy-peel layer being an outermost layer of the lid body, said opening of said lid body being covered with a gas-barrier film and said film being secured to a peripheral portion of the lid body surrounding the opening, said cap portion having a lower surface which faces an upper surface of the lid body, the cap portion having a peripheral portion, the lower surface of the peripheral portion of the cap portion being removably attached to the upper surface of the lid body through said gas-barrier film, said cap portion being configured so that after the cap portion has been separated from the lid body to open the opening in the lid body, the cap portion can be inverted and positioned within the opening in the lid body to reclose the opening.

2. A lid as recited in claim 1, wherein said gas-barrier film is a film comprising ethylene-vinyl alcohol.

3. A lid as recited in claim 1, wherein said cap portion gradually creases in outer peripheral size.

4. A lid as recited in claim 1, including a flange forming an outer periphery of the lid body for mounting the lid on an open end of a container.

5. A lid as recited in claim 1, wherein said cap portion of the pull cap covers the gas-barrier film that extends across the opening in the lid body.

6. A lid as recited in claim 1, wherein said thermoplastic resin is polyolefin.

7. A lid as recited in claim 6, wherein said gas-barrier film is a film comprising ethylene-vinyl alcohol.

8. A lid as recited in claim 1, wherein said pull cap is made of a material which is softer than said lid body.

9. A lid as recited in claim 8, wherein said pull cap is made of atactic polyolefin.

10. A beverage container lid, comprising a lid body and a pull cap, said lid body being provided with an opening through which can be discharged contents, said lid body including a periphery that is configured to permit the lid to be mounted on an open upper end of a container, said pull cap including a cap portion and a pull tab portion that are connected to one another, said lid body having an upper surface, a gas-barrier film sealed to the upper surface of the lid body and extending across the opening in the lid body to close said opening, said cap portion having a peripheral portion and also having a lower surface which faces the upper surface of the lid body, the lower surface of the cap portion being removably attached to the gas-barrier film along the peripheral portion of the cap portion to permit removal of the gas-barrier film covering the opening when the pull cap is separated from the lid body so that the opening in the lid body is opened, said cap portion being configured so that after the cap portion has been separated from the lid body to open the opening in the lid body, the cap portion can be inverted and positioned within the opening in the lid body to reclose the opening.

11. A lid as recited in claim 10, wherein the periphery of the lid body is provided with a flange to permit the lid to be mounted on the open upper end of a container.

12. A lid as recited in claim 10, wherein said lid body is made from a laminate that includes an easy-peel layer forming an outermost layer of the lid body.

13. A lid as recited in claim 10, wherein said thermoplastic resin is polyolefin.

14. A lid as recited in claim 10, wherein said gas-barrier film is a film comprising ethylene-vinyl alcohol.

15. A lid as recited in claim 10, wherein said cap portion gradually increases in outer peripheral size.

16. A lid as recited in claim 10, wherein said cap portion of the pull cap covers the gas-barrier film that extends across the opening in the lid body.

17. A lid as recited in claim 10, wherein said pull cap is made of a material which is softer than said lid body.

18. A lid as recited in claim 17, wherein said pull cap is made of atactic polyolefin.

* * * * *